US007174659B2

(12) United States Patent
Delgorgue

(10) Patent No.: US 7,174,659 B2
(45) Date of Patent: Feb. 13, 2007

(54) SOLE FOR A BOOT, AND A BOOT HAVING SUCH SOLE

(75) Inventor: Gerald Delgorgue, Ruffleux (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 10/299,783

(22) Filed: Nov. 20, 2002

(65) Prior Publication Data

US 2003/0093922 A1 May 22, 2003

(30) Foreign Application Priority Data

Nov. 21, 2001 (FR) ..... 01 15210

(51) Int. Cl.

| | |
|---|---|
| ***A43B 23/28*** | (2006.01) |
| ***A43B 13/22*** | (2006.01) |
| ***A43B 13/26*** | (2006.01) |
| ***A43B 13/14*** | (2006.01) |
| ***A43B 5/04*** | (2006.01) |
| ***A43C 15/00*** | (2006.01) |
| ***A43C 15/16*** | (2006.01) |

(52) U.S. Cl. ..... 36/59 R; 36/67 R; 36/31; 36/32 R

(58) Field of Classification Search ..... 36/59 R, 36/59 C, 67 R, 31, 32 R, 7.3, 7.6, 116
See application file for complete search history.

(56) References Cited

U.S. PATENT DOCUMENTS

| | | | | | |
|---|---|---|---|---|---|
| 2,162,912 | A | | 6/1939 | Craver | 36/59 |
| 3,841,374 | A | | 10/1974 | Boileau | 152/209 |
| 4,241,524 | A | * | 12/1980 | Sink | 36/32 R |
| 4,449,307 | A | * | 5/1984 | Stubblefield | 36/59 C |
| 4,546,556 | A | * | 10/1985 | Stubblefield | 36/59 C |
| 4,550,510 | A | * | 11/1985 | Stubblefield | 36/32 R |
| 4,607,440 | A | * | 8/1986 | Roberts et al. | 36/59 C |
| D287,182 | S | * | 12/1986 | Stubblefield | 36/32 R |
| 4,642,917 | A | * | 2/1987 | Ungar | 36/59 C |
| 5,423,135 | A | * | 6/1995 | Poole et al. | 36/59 C |
| 6,115,945 | A | * | 9/2000 | Ellis, III | 36/59 R |

FOREIGN PATENT DOCUMENTS

| | | | |
|---|---|---|---|
| CH | 172710 | | 10/1934 |
| CH | 218631 | | 12/1941 |
| EP | 0682886 | | 11/1995 |
| FR | 2785508 | | 5/2000 |
| JP | 10-337203 | | 12/1998 |
| WO | WO 91/11924 | * | 9/1991 |

* cited by examiner

*Primary Examiner*—Anthony Stashick
(74) *Attorney, Agent, or Firm*—Greenblum & Bernstein, P.L.C.

(57) ABSTRACT

A sole for a boot, as well as a boot having such sole, for walking on ice and/or snow having, in at least a central zone of the walking surface, a series of strips that are contiguous at rest, and crampons at its outer periphery. Each series of strips is interrupted by channels extending both in the transverse and longitudinal directions, and each crampon has a channel for evacuating water.

40 Claims, 3 Drawing Sheets

FIG.3
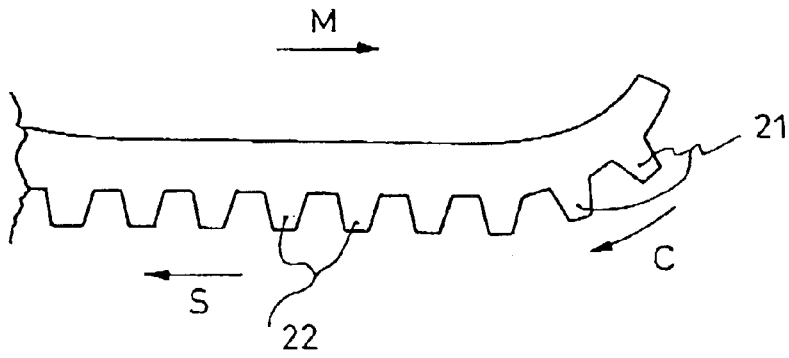
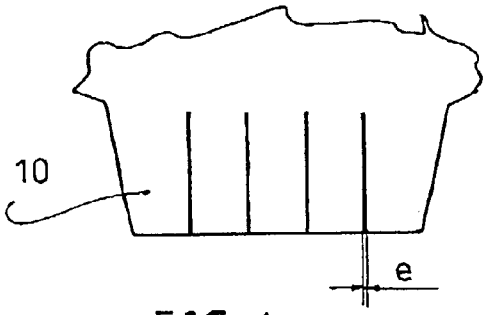
FIG.4
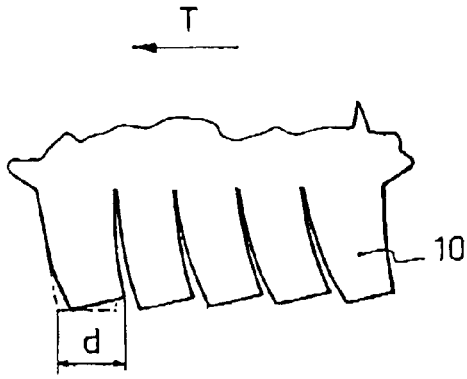
FIG.5

SOLE FOR A BOOT, AND A BOOT HAVING SUCH SOLE

CROSS-REFERENCE TO RELATED APPLICATION

This application is based upon French Patent Application No. 01.15210, filed Nov. 21, 2001, the disclosure of which is hereby incorporated by reference thereto in its entirety, and the priority of which is hereby claimed under 35 U.S.C. §119.

BACKGROUND OF THE INVENTION

1. Field of the Invention

The present invention relates to a boot sole adapted for walking on ice, or on icy and/or snow-covered ground, as well as to a boot having such a sole.

2. Description of Background and Relevant Information

In order to solve the drawback of walking on icy ground, it is known from CH 172 710 and CH 218 631 to fit the periphery of the sole with metal fittings or nails allowing for a better grip on ice. However, these nails and fittings have the drawback of being slippery on other surfaces, such as macadam, cement, or rocky ground.

Also, the fittings are not efficient for walking on snow-covered ground because snow adheres to the sole, gets caught between the fittings, and quickly forms clogs, making the fittings inefficient.

More recently, document JP 10337203 proposed including glass fibers in the sole, oriented and exposed toward the ground contact surface, so as to obtain an anti-slip effect on an icy or snow-covered surface.

This type of sole has the drawback of having a very high production cost.

In order to walk on smooth, slippery surfaces, such as wet or icy ground, document EP 682 886 discloses equipping the sole with peripheral profiled blocks provided with strips, the height thereof corresponding to the total height of the block. This type of boot is not very adapted to a combined use on snow and ice or to non-flat surfaces. Additionally, the significant depth of the strips makes them very sensitive to wear.

SUMMARY OF THE INVENTION

The present invention is provided for overcoming the aforementioned drawbacks and to propose, at a profitable cost, a sole allowing one to walk on ice as well as on snow, even over uneven ground, and avoiding the drawbacks of snow build-up.

The sole of the invention, for walking on ice has, in at least a central zone of the walking surface, a series of strips that are contiguous at rest, and crampons at its outer periphery.

It was surprisingly noted that the strips that are contiguous at rest and arranged in a central zone of the sole, allow one to have a good adherence to ice when walking, whereas the peripheral crampons allow for a good grip on snow.

BRIEF DESCRIPRION OF DRAWINGS

The invention will be better understood and other features thereof will become apparent from the following description, with reference to the attached schematic drawings, and in which:

FIG. 3 is a schematic side view showing the functioning of the lateral crampons;

FIG. 4 is a cross-sectional schematic view along the line IV—IV of FIG. 1, the strips being at rest;

FIG. 5 is a schematic view similar to FIG. 4 showing the functioning of the strips when walking;

DETAILED DESCRIPTION OF THE INVENTION

Figures 1, 6:
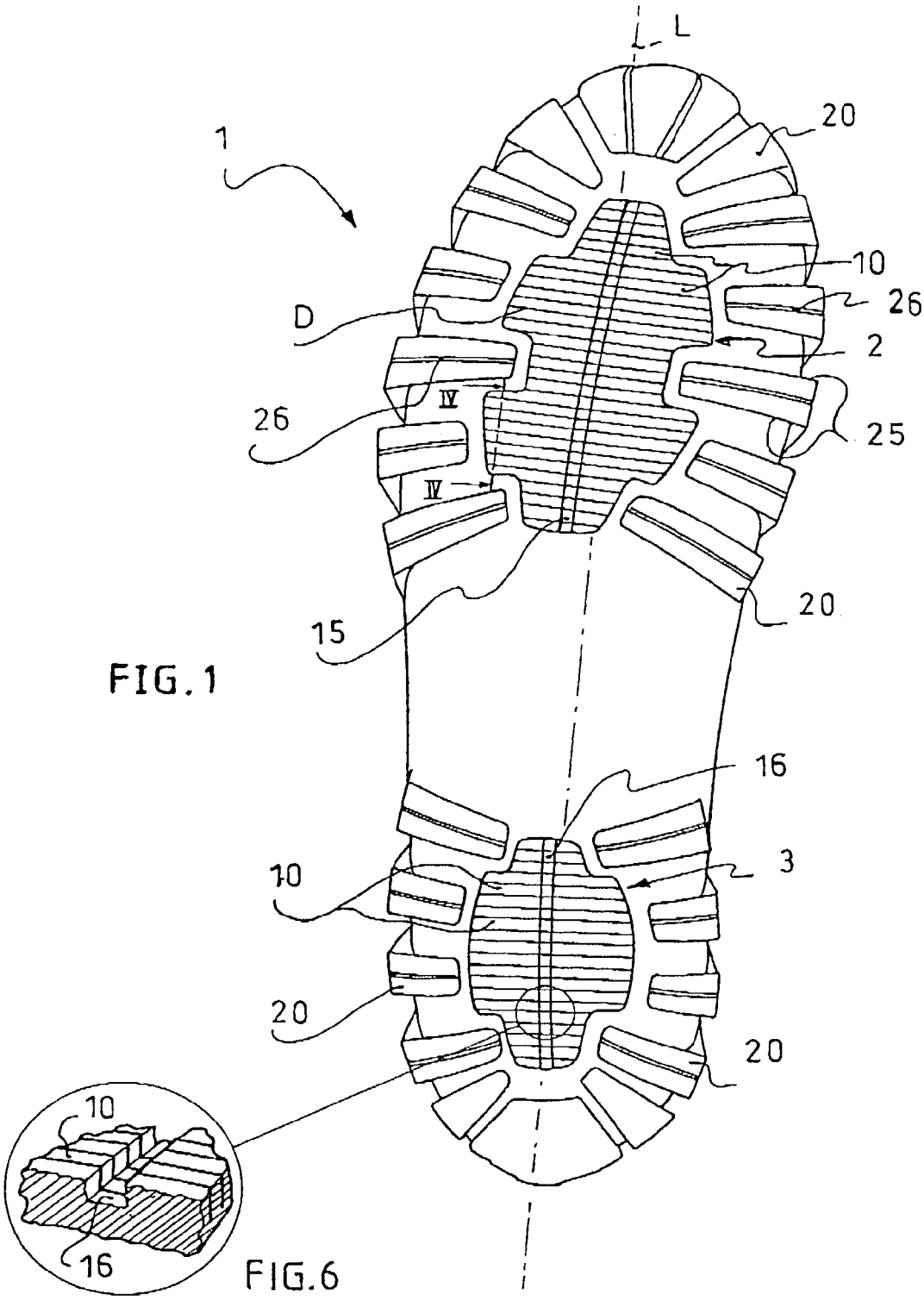
FIG. 1 is a bottom view of a sole according to a first embodiment.
FIG. 6 is a detailed perspective view of FIG. 1.

As shown in FIG. 1, the walking sole 1 according to the invention includes two central zones, front central zone 2 and rear central zone 3, respectively, each such zone comprising a block made up of a series or block of strips 10, completely contiguous, i.e., leaving no interval between two adjacent strips at rest.

In the example shown, each of the strips 10 is substantially straight and extends in a direction D substantially transverse to the longitudinal plane L of the sole.

Each block of strips 10 of the zones 2, 3 is furthermore surrounded by peripheral crampons 20, i.e., crampons that are flush with the edge of the sole and that are described in further detail below. The zones 2 and 3, therefore, are positioned transversely between opposite lateral sides of the periphery of the sole.

The strips 10 are made of a polymeric material, for example, a rubber-like material having a low hardness, preferably on the order of 55 shore A, and whose hardness varies little at low temperatures, down to approximately −20° C.

According to the invention, this material can be a rubber, but a polymer such as polyurethane, particularly expanded polyurethane having the desired properties of hardness and low variation at low temperature, is encompassed within the scope of the invention.

The strips 10 are cut with an appropriate sharp tool, having very thin blades, such as cutter blades.

According to a particular embodiment, each strip has a depth of approximately 4 millimeters (mm) and a width of approximately 2 mm for a block 2, 3 height of approximately 6 mm from the bottom surface of the sole, i.e., immediately adjacent the peripheral edges of the blocks 2, 3. Other dimensional features can be provided, particularly depending on the material constituting these soles and the temperature range of use. According to the invention, the strips 10 have a depth that does not exceed three-fourths of the height of the associated block 2, 3, so as to limit wear on these strips and to avoid a premature wear. Nevertheless, this relative depth could be increased according to the scope of the invention, depending on the effect desired.

FIGS. 4 and 5 show the functioning of the strips 10. At rest, i.e., without any load as shown in FIG. 4, the spacing "e" between two successive strips is zero and the strips 10 seem to be completely contiguous, and more specifically, at the free end of the ground-contacting surface of the sole. As shown in FIG. 4, the strips 10 are completely parallel and substantially straight at rest, the strips having lower ground-engaging surfaces and inner surfaces that are contiguous with, or that abut, one another.

When the wearer walks, tangential forces T occur, the strips 10 then deform elastically as shown in "d" in FIG. 5 and oppose the slipping of the sole, even on ice. In FIG. 5 the inner surfaces of the strips 10 are shown to have separated from one another somewhat.

Furthermore, because the strips 10 are very close to each other, one avoids the effect of snow accumulation or build-up that is known in prior systems, and the effect of resistance to slipping does not change over time.

Preferably, as shown more particularly in FIG. 6, channels 15 and 16 having a smaller depth than that of the strips 10, in this case, a depth approximately equal to 2 mm or 3 mm, are provided to evacuate the water that forms when rubbing the sole over ice or to break this film of water.

In the example of FIG. 1, the channels 15 and 16 are longitudinal but other shapes can also be envisioned, such as those described below.

As mentioned above, the sole includes crampons 20 at the outer periphery of the sole. In the embodiments shown in FIG. 2 and 3, the crampons extend to the very edge of the walking surface of the sole. The peripheral crampons 20 are, contrary to the strips 10, widely spaced apart so as to provide a "serrated" type of hold. In other words, and as shown in FIG. 3, during the rolling movement of the foot when walking (arrow M), the first crampons 21 work rearwardly from the top down (arrow C) by compacting the snow, then the next crampons 22 shear it (arrow S) to provide the desired grip on the snow.

Figure 2:
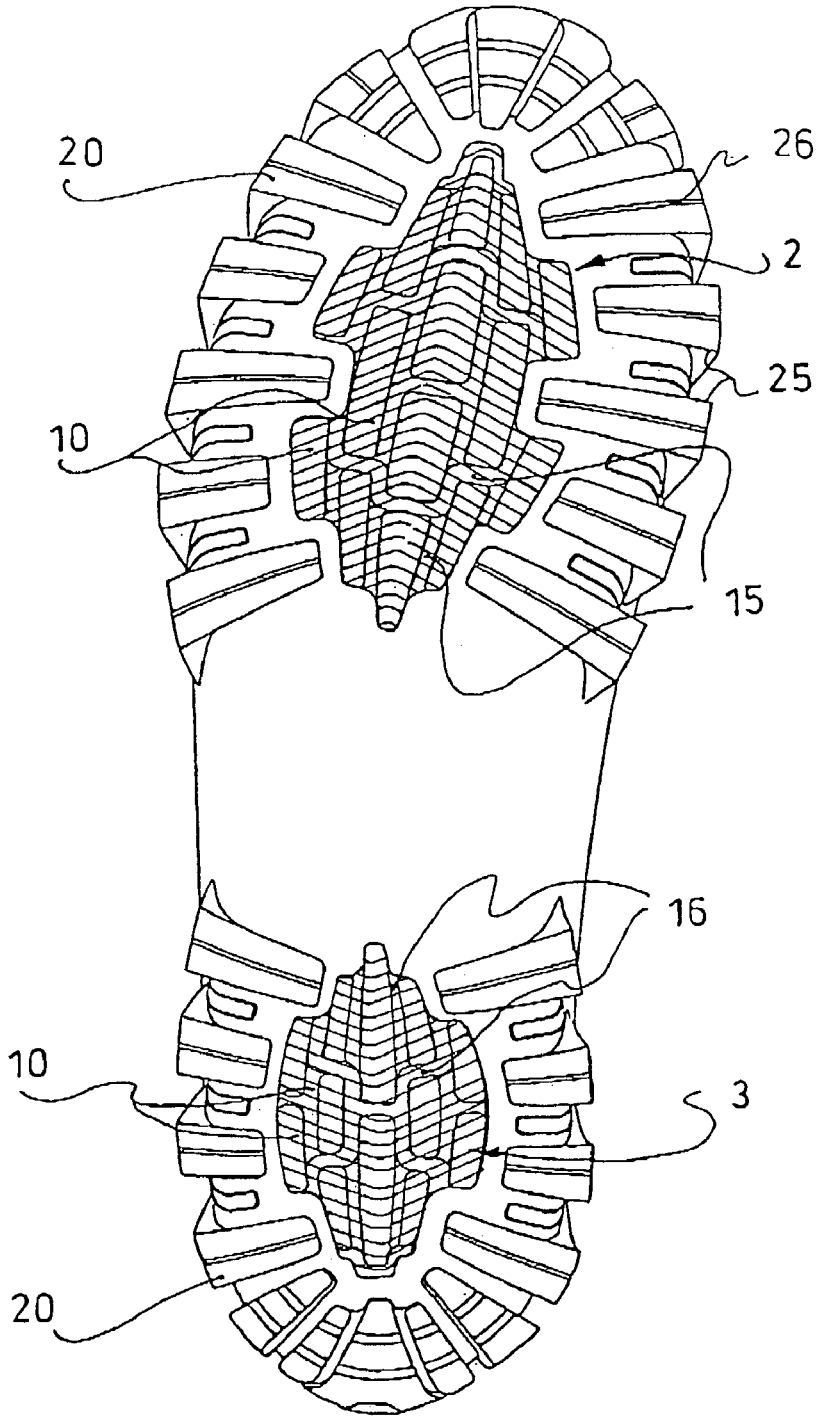
FIG. 2 is a view similar to FIG. 1 of a sole according to a second embodiment.

These crampons 20 preferably have a shape that is very "square," substantially rectangular, with numerous straight edges 25 for an optimal grip. Each crampon 20 is furthermore provided with at least one channel 26 for evacuating water. As shown in the embodiments of FIGS. 1 and 2, the channels 26 extend in a direction from the central zones 2 and 3 toward the outer periphery of the walking surface of the sole. Each crampon 20 has a longitudinal dimension of approximately 10–15 mm and a transverse direction varying between 20 mm and 40 mm. Two successive crampons are separated by approximately 10 mm, so as to have the desired effect of a serrated grip. Thus, the strips 10 and the crampons 20 cooperate for an optimal hold on snow and on ice.

The crampons 20 are preferably made of the same material as the strips 10. As the case may be and depending on the effect sought, such as, for instance, a use on a very soft snow, the crampons 20 could be made of a harder polymeric material, up to 70 shore A.

The strips 10 can be straight as shown in FIG. 1. However, they will preferably have a sinusoidal type shape in order to provide a grip in different directions.

FIG. 2 shows a preferred embodiment in which the strips 10 are V-shaped/chevron-shaped, i.e., oriented according to a triangle. In this case, the strips 10 of the rear block 3 are oriented opposite the strips of the front block 2 in order to have a braking action during the driving, or thrusting, force of the heel.

In the example of FIG. 2, one can also note the shape of the evacuation channels 15, 16 that extend both in the direction of the longitudinal plane L as well as in the transverse direction D.

The present invention is not limited to the previously described particular embodiments given by way of non-limiting examples, but it encompasses all similar or equivalent embodiments.

What is claimed is:

1. A sole for walking on ice and/or snow, said sole comprising:

a walking surface having at least one central zone and an outer periphery;

a series of strips in at least said central zone of said walking surface, strips within said series of strips extending to ground-engaging free ends, with no interval between successive pairs of said free ends at rest, each said strip in said series of strips having a depth of approximately 4 mm;

said series of strips in said central zone comprising a block of strips, said block having a height, extending from a bottom surface of the sole, of approximately 6 mm;

crampons at said outer periphery of said walking surface.

2. A sole according to claim 1, wherein the said strips extend in a direction substantially transverse with respect to a longitudinal axis of the sole.

3. A sole according to claim 1, wherein said strips are substantially straight.

4. A sole according to claim 1, wherein said strips extend transversely relative to a vertical longitudinal plane of the sole in a V-shaped/chevron-shaped path.

5. A sole according to claim 1, wherein said central zone comprises a front central zone.

6. A sole according to claim 1, wherein said central zone comprises a rear central zone.

7. A sole according to claim 1, wherein the said central zone comprises a front central zone and a rear central zone, said series of strips being in said front central zone, the sole further comprising a series of strips in said rear central zone.

8. A sole according to claim 1, wherein each said strip in said series of strips has a width of approximately 2 mm.

9. A sole according to claim 1, wherein each of said series of strips is interrupted by a plurality of channels extending in a transverse direction and a plurality of channels extending in a longitudinal direction.

10. A sole according to claim 9, wherein each said channel has a maximum depth of approximately 3 mm.

11. A sole according to claim 1, wherein the sole is constituted of a polymer material having a hardness of approximately 55 shore A.

12. A sole according to claim 1, wherein each said crampon includes a channel for evacuating water.

13. A boot comprising:

an external sole for walking on ice and/or snow, said sole having a walking surface, said walking surface having at least one central zone and an outer periphery;

in at least said central zone of said walking surface, said sole comprising a series of strips, strips within said series of strips extending to ground-engaging free ends, with no interval between successive pairs of said free ends at rest;

said at least one central zone comprises a first block of strips comprising a front central zone and a second block of strips comprising a rear central zone, each of said first and second blocks of strips having a height extending from a bottom surface of the sole to the free ends of the strips; and at said outer periphery of said walking surface, said sole further comprises crampons, said crampons comprising:

a plurality of crampons at a side of said first block of strips and a plurality of crampons at an opposite side of said first block of strips; and a plurality of crampons at a side of said second block of strips and a plurality of crampons at an opposite side of said second block of strips.

14. A boot according to claim 13, wherein said strips within said series of strips have abutting inner surfaces.

15. A boot according to claim 13, wherein said series of strips have ends spaced transversely from said outer periphery of said walking surface.

16. A boot according to claim 13, wherein an entirety of said rear central zone is longitudinally spaced apart from said front central zone.

17. A boot comprising:

an external sole for walking on ice and/or snow, said sole having a walking surface, said walking surface having at least one central zone and an outer periphery;

in at least said central zone of said walking surface, said sole comprising a series of strips, strips within said series of strips extending to ground-engaging free ends, with no interval between successive pairs of said free ends at rest;

said at least one central zone comprises a first block of strips comprising a front central zone and a second block of strips comprising a rear central zone, each of said first and second blocks of strips having a height extending from a bottom surface of the sole to the free ends of the strips; and at said outer periphery of said walking surface, said sole further comprises crampons, said crampons comprising:

a plurality of crampons extending along said outer periphery at a side of said first block of strips, around a front of said sole, and along said outer periphery at an opposite side of said first block of strips; and a plurality of crampons extending along said outer periphery at a side of said second block of strips, around a rear of said sole, and along said outer periphery at an opposite side of said second block of strips.

18. A sole according to claim 1, wherein said strips within said series of strips have abutting inner surfaces.

19. A sole according to claim 1, wherein said series of strips have ends spaced transversely from said outer periphery of said walking surface.

20. A sole according to claim 12, wherein said channels of said crampons extend in a direction from any of said at least one central zone toward said outer periphery.

21. An article of footwear comprising:

a sole having a structure adapted to facilitate walking on ice and snow, said sole having a walking surface, said walking surface having an outer periphery and at least one zone inwardly spaced from said outer periphery;

in at least said one zone of said walking surface said sole comprising a plurality of strips, said plurality of strips having inner surfaces extending to ground-engaging free ends, said inner surfaces extending in a direction through a longitudinal plane of the article of footwear, said free ends of the plurality of strips being contiguous with one another at rest, with no interval between successive pairs of said free ends at rest;

said at least one zone comprising a front central zone and a rear central zone;

said plurality of strips comprising a first block of strips in said front central zone and a second block of strips in said rear central zone, each of said first and second blocks of strips having a height extending from a bottom surface of the sole to the ground-engaging free ends of the plurality of strips;

a plurality of crampons extending to said outer periphery of said walking surface, said plurality of crampons surrounding said plurality of strips on opposed sides and opposed ends of the sole.

22. An article of footwear according to claim 21, wherein:

said at least one zone of said walking surface is positioned in an area of a heel of the article of footwear.

23. An article of footwear according to claim 21, wherein:

said plurality of strips have ends spaced transversely from said outer periphery of said walking surface.

24. An article of footwear according to claim 21, wherein:

said at least one zone of said walking surface comprises two zones inwardly spaced from said outer periphery of said sole, said two zones comprise:

a rear zone positioned in an area of a heel of the article of footwear; and a front zone longitudinally spaced entirely from said rear zone;

each of said two zones comprises a plurality of strips, said plurality of strips having inner surfaces extending to ground-engaging free ends, said inner surfaces extending in a direction through a longitudinal plane of the article of footwear, said free ends of the plurality of strips of both of said two zones of said walking surface being contiguous with one another at rest, with no interval between successive pairs of said free ends of said plurality of strips at rest;

the plurality of strips of both said front and rear zones comprise strips positioned between transversely opposed pluralities of said crampons.

25. An article of footwear comprising:

a sole having a structure adapted to facilitate walking on ice and snow, said sole having a walking surface, said walking surface having an outer periphery, a front central zone and a rear central zone, each of said zones being inwardly spaced from said outer periphery;

in each of said zones of said walking surface said sole comprising a plurality of strips, said plurality of strips comprising a first block of strips in said front central zone and a second block of strips in said rear central zone, said plurality of strips having inner surfaces extending to ground-engaging free ends, said inner surfaces extending in a direction through a longitudinal plane of the article of footwear, said free ends of the plurality of strips of both of the first and second blocks of strips being contiguous with one another at rest, with no interval between successive pairs of said free ends of the plurality strips at rest;

said plurality of strips comprising a first block of strips in said front central zone and a second block of strips in said rear central zone, each of said first and second blocks of strips having a height extending from a bottom surface of the sole to the ground-engaging free ends of the plurality of strips;

a plurality of crampons extending to said outer periphery of said walking surface, said plurality of crampons comprising:

a plurality of crampons at a side of said first block of strips and a plurality of crampons at an opposite side of said first block of strips; and a plurality of crampons at a side of said second block of strips and a plurality of crampons at an opposite side of said second block of strips.

26. An article of footwear comprising:

a sole having a structure adapted to facilitate walking on ice and snow, said sole having a walking surface, said walking surface having an outer periphery, a front central zone and a rear central zone, each of said zones being inwardly spaced from said outer periphery;

in each of said zones of said walking surface said sole comprising a plurality of strips, said plurality of strips comprising a first block of strips in said front central zone and a second block of strips in said rear central zone, said plurality of strips having inner surfaces extending to ground-engaging free ends, said inner surfaces extending in a direction through a longitudinal plane of the article of footwear, said free ends of the plurality of strips of both of the first and second blocks of strips being contiguous with one another at rest, with no interval between successive pairs of said free ends of the plurality of strips at rest;

said plurality of strips comprising a first block of strips in said front central zone and a second block of strips in said rear central zone, each of said first and second blocks of strips having a height extending from a bottom surface of the sole to the ground-engaging free ends of the plurality of strips;

a plurality of crampons extending to said outer periphery of said walking surface, said plurality of crampons comprising:

a plurality of crampons extending along said outer periphery at a side of said first block of strips, around a front of said sole, and along said outer periphery at an opposite side of said first block of strips; and a plurality of crampons extending along said outer periphery at a side of said second block of strips, around a rear of said sole, and along said outer periphery at an opposite side of said second block of strips.

27. A boot according to claim 13, wherein said strips have a depth within said height of said first and second blocks of strips that does not exceed three-fourths of said height.

28. A boot according to claim 27, wherein said height of said first and second blocks of strips is approximately 6 mm and said depth of said strips is between two-thirds and three-fourths of said height.

29. A boot according to claim 17, wherein said strips have a depth within said height of said first and second blocks of strips that does not exceed three-fourths of said height.

30. A boot according to claim 29, wherein said height of said first and second blocks of strips is approximately 6 mm and said depth of said strips is between two-thirds and three-fourths of said height.

31. An article of footwear according to claim 21 wherein:

said strips within said first and second blocks of strips have a depth that does not exceed three-fourths of said height of said first and second blocks.

32. An article of footwear according to claim 31, wherein:

said height of said first and second blocks of strips is approximately 6 mm; and said depth of said strips is between two-thirds and three-fourths of said height.

33. An article of footwear according to claim 25, wherein:

said strips within said first and second blocks of strips have a depth that does not exceed three-fourths of said height of said first and second blocks.

34. An article of footwear according to claim 33, wherein:

said height of said first and second blocks of strips is approximately 6 mm; and said depth of said strips is between two-thirds and three-fourths of said height.

35. An article of footwear according to claim 26, wherein:

said strips within said first and second blocks of strips have a depth that does not exceed three-fourths of said height of said first and second blocks.

36. An article of footwear according to claim 35, wherein:

said height of said first and second blocks of strips is approximately 6 mm; and said depth of said strips is between two-thirds and three-fourths of said height.

37. An article of footwear according to claim 25, wherein:

said second block of strips in said rear central zone of said walking surface comprises a block of strips in an area of a heel of the article of footwear.

38. An article of footwear according to claim 21, wherein:

each of said first and second blocks of strips is interrupted by a plurality of channels extending in a transverse direction and a plurality of channels extending in a longitudinal direction, said channels having a depth less than a depth of said strips of said first and second blocks of strips.

39. An article of footwear according to claim 25, wherein:

each of said first and second blocks of strips is interrupted by a plurality of channels extending in a transverse direction and a plurality of channels extending in a longitudinal direction, said channels having a depth less than a depth of said strips of said first and second blocks of strips.

40. An article of footwear according to claim 26, wherein:

each of said first and second blocks of strips is interrupted by a plurality of channels extending in a transverse direction and a plurality of channels extending in a longitudinal direction, said channels having a depth less than a depth of said strips of said first and second blocks of strips.

* * * * *